US009235171B2

(12) United States Patent
Ohara et al.

(10) Patent No.: US 9,235,171 B2
(45) Date of Patent: Jan. 12, 2016

(54) FIXING DEVICE HAVING HEATING PORTION WITH RIGIDITY ADJUSTING PORTIONS AND IMAGE FORMING APPARATUS

(71) Applicant: FUJI XEROX CO., LTD, Minato-ku, Tokyo (JP)

(72) Inventors: Hideaki Ohara, Kanagawa (JP); Mitsuhiro Matsumoto, Kanagawa (JP); Kazuyoshi Ito, Kanagawa (JP); Yasuhiro Uehara, Kanagawa (JP); Mikio Saiki, Kanagawa (JP); Hiromi Nagai, Kanagawa (JP); Nobuyoshi Komatsu, Kanagawa (JP); Hiroki Murakami, Kanagawa (JP); Junji Okada, Kanagawa (JP); Kimiyuki Kawakami, Kanagawa (JP); Tadashi Suto, Kanagawa (JP)

(73) Assignee: FUJI XEROX CO., LTD, Tokyo (JP)

( * ) Notice: Subject to any disclaimer, the term of this patent is extended or adjusted under 35 U.S.C. 154(b) by 0 days.

(21) Appl. No.: 14/272,963

(22) Filed: May 8, 2014

(65) Prior Publication Data

US 2015/0125191 A1 May 7, 2015

(30) Foreign Application Priority Data

Nov. 1, 2013 (JP) ..... 2013-228573

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/2053; G03G 15/2064; G03G 2215/2016; G03G 2215/2019; G03G 2215/2029; G03G 2215/2035
USPC ..... 399/329; 219/216
See application file for complete search history.

(56) References Cited

U.S. PATENT DOCUMENTS

| | | | | |
|---|---|---|---|---|
| 8,150,304 | B2 * | 4/2012 | Kagawa et al. | 399/329 |
| 8,175,508 | B2 * | 5/2012 | Kageyama | 399/329 |
| 2003/0183610 | A1 * | 10/2003 | Okabayashi et al. | 219/216 |
| 2003/0185605 | A1 | 10/2003 | Okabayashi | |
| 2009/0257795 | A1 | 10/2009 | Kageyama | |
| 2010/0303527 | A1 * | 12/2010 | Mitsuoka | 399/329 |
| 2011/0052279 | A1 * | 3/2011 | Kagawa | 399/329 |
| 2011/0217093 | A1 * | 9/2011 | Tokuda et al. | 399/329 |
| 2011/0299904 | A1 * | 12/2011 | Oishi et al. | 399/329 |
| 2013/0170878 | A1 * | 7/2013 | Kuroda | 399/329 |
| 2015/0030360 | A1 * | 1/2015 | Saiki et al. | 399/329 |
| 2015/0110530 | A1 * | 4/2015 | Uehara et al. | 399/329 |

FOREIGN PATENT DOCUMENTS

| | | | |
|---|---|---|---|
| JP | 2003-287970 A | | 10/2003 |
| JP | 2006293051 A | * | 10/2006 |
| JP | 2009-258243 A | | 11/2009 |
| JP | 2013044918 A | * | 3/2013 |

* cited by examiner

*Primary Examiner* — Robert Beatty
(74) *Attorney, Agent, or Firm* — Sughrue Mion, PLLC

(57) ABSTRACT

Provided is a fixing device including a heating unit that includes a circularly moving heating belt, and a pressurizing roller that presses an external face of the heating belt, the fixing device fixing a toner image on a sheet onto the sheet by nipping the sheet between the heating belt and the pressurizing roller and by heating and pressurizing the sheet transported with the toner image being held.

15 Claims, 8 Drawing Sheets

FIXING DEVICE HAVING HEATING PORTION WITH RIGIDITY ADJUSTING PORTIONS AND IMAGE FORMING APPARATUS

CROSS-REFERENCE TO RELATED APPLICATIONS

This application is based on and claims priority under 35 USC 119 from Japanese Patent Application No. 2013-228573 filed Nov. 1, 2013.

BACKGROUND

Technical Field

The present invention relates to a fixing device, and an image forming apparatus.

SUMMARY

According to an aspect of the invention, there is provided a fixing device including:

a heating unit that includes a circularly moving heating belt; and a pressurizing roller that presses an external face of the heating belt, the fixing device fixing a toner image on a sheet onto the sheet by nipping the sheet between the heating belt and the pressurizing roller and by heating and pressurizing the sheet transported with the toner image being held, wherein the heating unit, further includes:

a backing member that is arranged on an inner surface side of an area of the heating belt which is pressed by the pressurizing roller, and receives pressurization from the pressurizing roller;

a heater that has a plate shape, is arranged on an inner side of the heating belt in a state of being curved in a circular movement direction of the heating belt, and comes into contact with an inner surface of the heating belt to heat the heating belt from the inner side; and a supporting member that is arranged on the inner side of the heating belt, and fixes a fixed portion of the heater in the circular movement direction, and wherein the heater, further includes:

a heating portion that includes a resistance heating element which is energized to generate heat; and a rigidity adjusting unit that is formed between the heating portion and the fixed portion in the circular movement direction, and includes a rigidity adjusting body which approximates a rigidity to a rigidity of the heating portion without generating heat by energization.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described.

Figure 1:
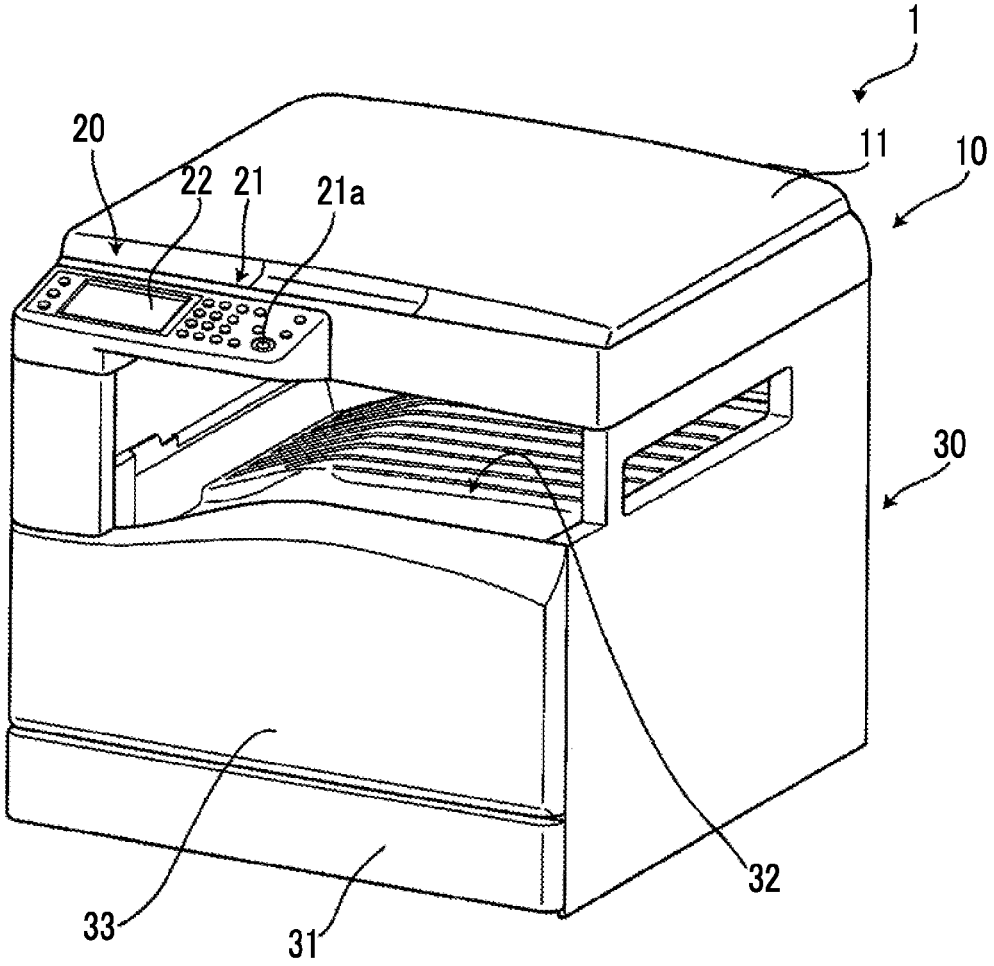
FIG. 1 is an external perspective view of a printer as an exemplary embodiment of an image forming apparatus according to the invention.

FIG. 1 is an external perspective view of a printer as an exemplary embodiment of an image forming apparatus according to the invention. A fixing unit, which is an exemplary embodiment of a fixing device according to the invention, is assembled into the printer.

An image reading unit 10 that reads an image from an original document is provided in an upper portion of a printer 1. The image reading unit 10 includes a cover 11. The cover 11 is opened and closed by using a hinge on a back surface side as an axis of rotation. An image on the original document is read and image data is generated when the cover 11 is opened, the original document is set face-down, the cover 11 is closed, and a start button 21*a* is pressed.

A user interface 20, which includes an operation button 21 including the above-described start button 21*a* and a display screen 22, is provided in the printer 1.

The printer 1 further includes an image forming unit 30 that forms an image on a sheet based on the image data by using toner.

A drawable sheet tray 31 is provided in a lower portion of the image forming unit 30. The sheets before image formation, which are used to form the image, are stacked and accommodated in the sheet tray 31. The sheet is taken out of the sheet tray 31 in the image forming unit 30, and the image is formed on the sheet. The sheet, on which the image is formed, is discharged onto a discharge tray 32 in an upper portion of the image forming unit 30.

In addition, the image forming unit 30 includes a front cover 33, which may be opened and closed in an upper portion of the sheet tray 31.

The image formation by the image forming unit 30 is performed based on the image data that is obtained through the reading by the image reading unit 10. However, the image is formed by the image forming unit 30 also based on image data received from external equipment such as an image editing computer or the like.

Figure 2:
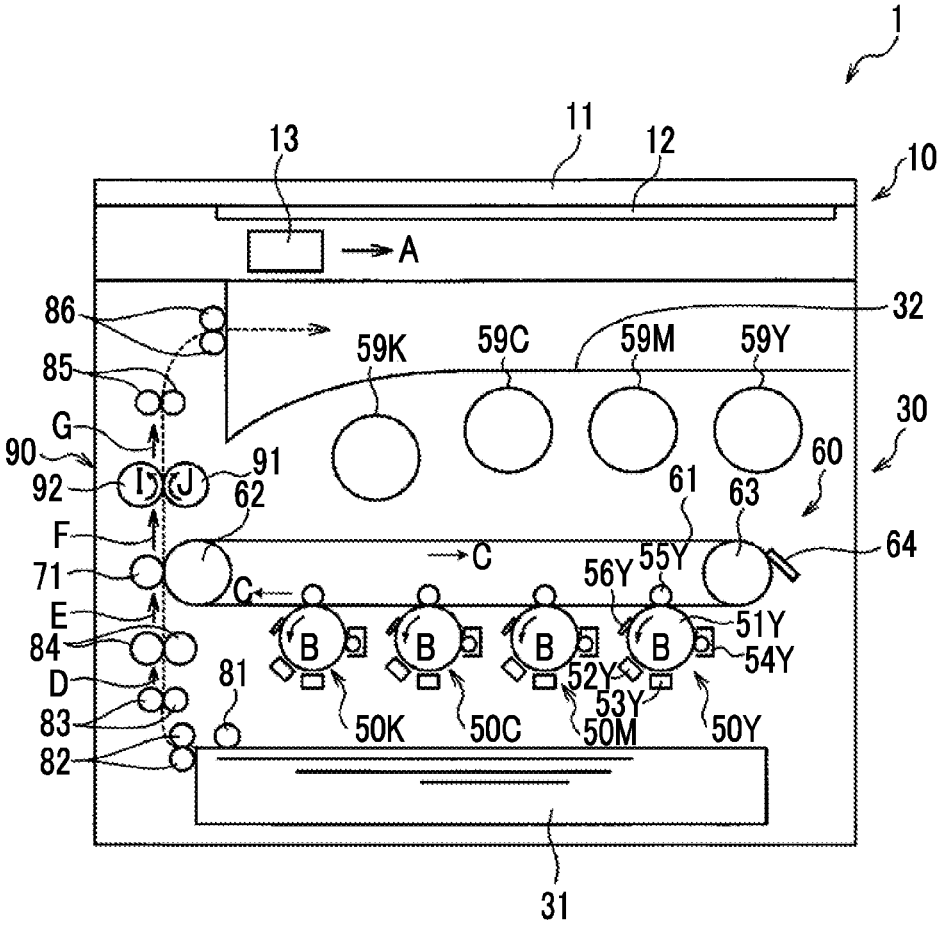
FIG. 2 is a schematic diagram illustrating an overview of an internal configuration of the printer illustrated in FIG. 1.

FIG. 2 is a schematic diagram illustrating an overview of an internal configuration of the printer illustrated in FIG. 1.

A transparent glass plate 12 is provided directly below the cover 11 of the image reading unit 10 in the upper portion of the printer 1. The original document is placed, face-down, on the transparent glass plate 12 after the cover 11 is opened. An image reading sensor 13, which reads the image on the original document, is provided below the transparent glass plate 12. The image reading sensor 13 extends in a depth direction (direction vertical to a page face in FIG. 2) of the printer 1, and sequentially reads the images on the original documents, while moving in an arrow A direction, to generate the image data.

Four image forming engines 50Y, 50M, 50C, and 50K, which are arranged in parallel, are provided in the upper portion of the sheet tray 31 of the image forming unit 30. The image forming engines 50Y, 50M, 50C, and 50K are engines that form toner images respectively with toner which have yellow (Y), magenta (M), cyan (C), and black (K) colors. The image forming engines 50Y, 50M, 50C, and 50K have the same configuration except for the colors of the toner used. Hereinafter, signs Y, M, C, and K, which represent the colors, will be omitted when distinction of the colors is not necessary and description will be made with only the numbers.

Each of the image forming engines 50 includes a photoconductor drum 51 that rotates in an arrow B direction. In addition, a charging unit 52, an exposure unit 53, a developing unit 54, a transfer unit 55, and a cleaner 56 are provided, in each of the image forming engines 50, around the photoconductor drum 51.

The charging unit 52 uniformly charges an outer surface of the photoconductor drum 51.

The exposure unit 53 irradiates the photoconductor drum 51 with an exposure light beam modulated according to the image data, and forms an electrostatic latent image on the outer surface of the photoconductor drum 51.

Toner having the colors (Y, M, C, and K) corresponding to the image forming engines 50Y, 50M, 50C, and 50K are accommodated in the developing unit 54. The developing unit develops the electrostatic latent image on the photoconductor drum 51 with the accommodated toner, and forms the toner image on the photoconductor drum 51.

An intermediate image transfer belt 61 is arranged above the four image forming engines 50Y, 50M, 50C, and 50K which are arranged in parallel. The intermediate image transfer belt 61 is a belt having an endless shape, and is wound around rollers 62 and 63. The intermediate image transfer belt 61 circularly moves, in an arrow C direction, on a circular movement path along the four image forming engines 50Y, 50M, 50C, and 50K.

Four toner cartridges 59Y, 59M, 59C, and 59K, in which the toner having the colors (Y, M, C, and K) are respectively accommodated, are provided above the intermediate image transfer belt 61. When the toner in each of the developing units 54 provided in each of the image forming engines 50 decreases, the toner is replenished from the corresponding toner cartridge 59 to the developing unit 54.

Each of the transfer units 55 of the image forming engines 50 is arranged inside the intermediate image transfer belt 61 such that the intermediate image transfer belt 61 is nipped between the photoconductor drum 51 and the transfer unit 55. The toner image that is formed on the photoconductor drum 51 is transferred onto the intermediate image transfer belt 61 through an operation of the transfer unit 55. Herein, the four toner images that are formed by the four image forming engines 50Y, 50M, 50C, and 50K are transferred to be sequentially overlapped on the intermediate image transfer belt 61 through the circular movement of the intermediate image transfer belt 61.

The cleaner 56 cleans the photoconductor drum 51 by removing the unnecessary toner, which remains on the photoconductor drum 51 after the transfer, from the photoconductor drum 51.

The toner images that are transferred to be sequentially overlapped on the intermediate image transfer belt 61 are transported by the intermediate image transfer belt 61, and are transferred onto the sheet through an operation of a secondary transfer unit 71. The unnecessary toner that remains on the intermediate image transfer belt 61 after the transfer onto the sheet is removed from the intermediate image transfer belt 61 by a cleaner 64.

The sheet that is accommodated in the sheet tray 31 is taken out by a pickup roller 81. When the plural stacked sheets are taken out, the sheets are reliably separated, sheet by sheet, by a separation roller 82, and each of the sheets is transported to a timing adjusting roller 84 in an arrow D direction by a transport roller 83.

Then, timing is adjusted such that the sheet is transported to a position of the secondary transfer unit 71 in synchronization with timing when the toner image transferred onto the intermediate image transfer belt 61 is transported to the position of the secondary transfer unit 71, and the sheet is sent out in an arrow E direction by the timing adjusting roller 84. Then, the toner image on the intermediate image transfer belt 61 is transferred onto the sheet through an operation of the secondary transfer unit 71.

The sheet, which receives the transfer of the toner image, is transported further in an arrow F direction and passes through a fixing unit 90. The fixing unit 90 includes a pressurizing roller 91 that rotates in an arrow I direction, and a heating unit 100 that includes a heating belt 101 (refer to FIG. 3) which circularly moves in an arrow J direction.

The sheet that is transported to the fixing unit 90 is nipped by the pressurizing roller 91 and the heating belt 101 to be pressurized and heated. In this manner, the toner image on the sheet is fixed onto the sheet.

The sheet that passes through the fixing unit 90 is transported further in an arrow G direction by a transport roller 85, and is discharged onto the discharge tray 32, which is disposed in the upper portion of the image forming unit 30, by a discharge roller 86.

Figure 3:
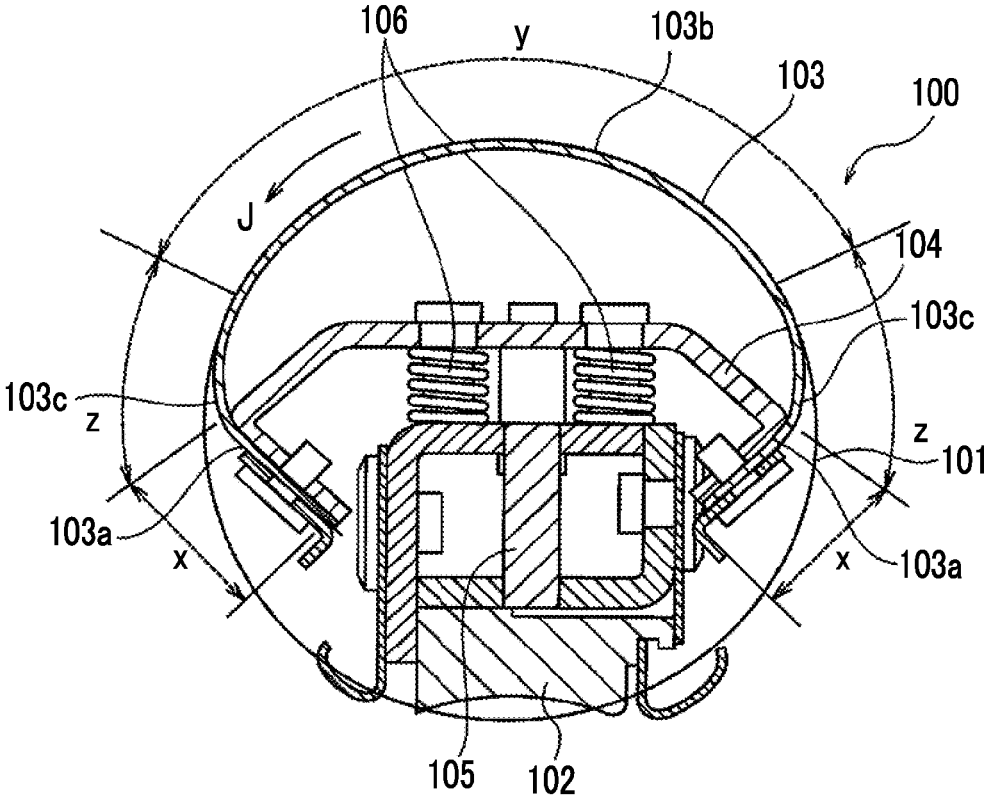
FIG. 3 is a schematic cross-sectional view of a heating unit that constitutes a fixing unit.

FIG. 3 is a schematic cross-sectional view of the heating unit that constitutes the fixing unit.

As described above, the heating unit 100 includes the heating belt 101. The heating belt 101 is a belt that has an endless shape, and is driven by a rotation of the pressurizing roller 91 in the arrow I direction (refer to FIG. 2) to circularly move in the arrow J direction. However, for example, when a gear is adhered to an axial end portion of the heating belt 101 and the heating belt 101 and the pressurizing roller 91 are separated from each other, the heating belt 101 may be driven independently via the gear from a driving source so as to shorten a start-up time.

The heating unit 100 further includes a backing member 102, a heater 103, a supporting member 104, and a core material 105 in addition to the heating belt 101. The backing member 102 is a member that is arranged on an inner surface side of an area of the heating belt 101 which is pressed by the pressurizing roller 91 (refer to FIG. 2) and receives pressure from the pressurizing roller 91. The backing member 102 is supported by the core material 105.

The heating belt 101 crosses the backing member 102 in FIG. 3. However, this is to illustrate a state of the heating belt 101 where no interference is present between the heating belt 101 and the backing member 102. In an actual structure, the backing member 102 abuts against an inner surface of the heating belt 101, and the heating belt 101 is deformed according to a shape of the backing member 102 and circularly moves.

In addition, the heater 103 comes into contact with the inner surface of the heating belt 101 to heat the heating belt 101 from the inner surface thereof. The heater 103 is arranged on the inner surface of the heating belt 101 that has a plate shape in a state where the heater 103 is curved in the circular movement direction (arrow J direction) of the heating belt 101.

In the heater 103, fixed portions 103*a* are formed in areas at both ends of the heating belt 101 in the circular movement direction (arrow J direction), which are illustrated with an arrow x, and the fixed portions 103*a* are fixed to the supporting member 104. In addition, in the heater 103, a space is present between the fixed portions 103*a* at both of the ends in the circular movement direction (arrow J direction) of the heating belt 101, and a heating portion 103*b* is formed in a central area (area illustrated with an arrow y) of the heating belt 101 in the circular movement direction. The heating portion 103*b* is an area that includes a resistance heating element which is energized to generate heat.

Herein, when a non-contact part is present between the heating portion 103*b* and the heating belt 101, the part has an increasing temperature. Accordingly, the heating portion 103*b* is required to be in contact with the heating belt 101.

Further, in the heater 103, rigidity adjusting units 103*c* are formed in areas on both sides, which are illustrated with an arrow Z, of the heating portion 103*b* in the circular movement direction. A rigidity adjusting body, which approximates rigidity to rigidity of the heating portion 103*b* without heat generation caused by energization, is provided in the rigidity adjusting unit 103*c*. The rigidity adjusting body will be described in detail later. In this exemplary embodiment, the rigidity adjusting body is formed of the same material as the resistance heating element of the heating portion 103*b*, and is formed to be connected to the resistance heating element.

In this exemplary embodiment, the supporting member 104 is a member that fixes the fixed portions 103*a* of the heater 103 that are at both of the end of the heating belt 101 in the circular movement direction. The supporting member 104 itself is supported by the core material 105 via a spring member 106.

The core material 105 extends out of the heating belt 101 from both sides of the heating belt 101 in a width direction (direction vertical to the page face in FIG. 3; arrow n-n direction illustrated in FIG. 4), and a part that comes out from the heating belt 101 is fixed to a frame (not illustrated).

Figure 4:
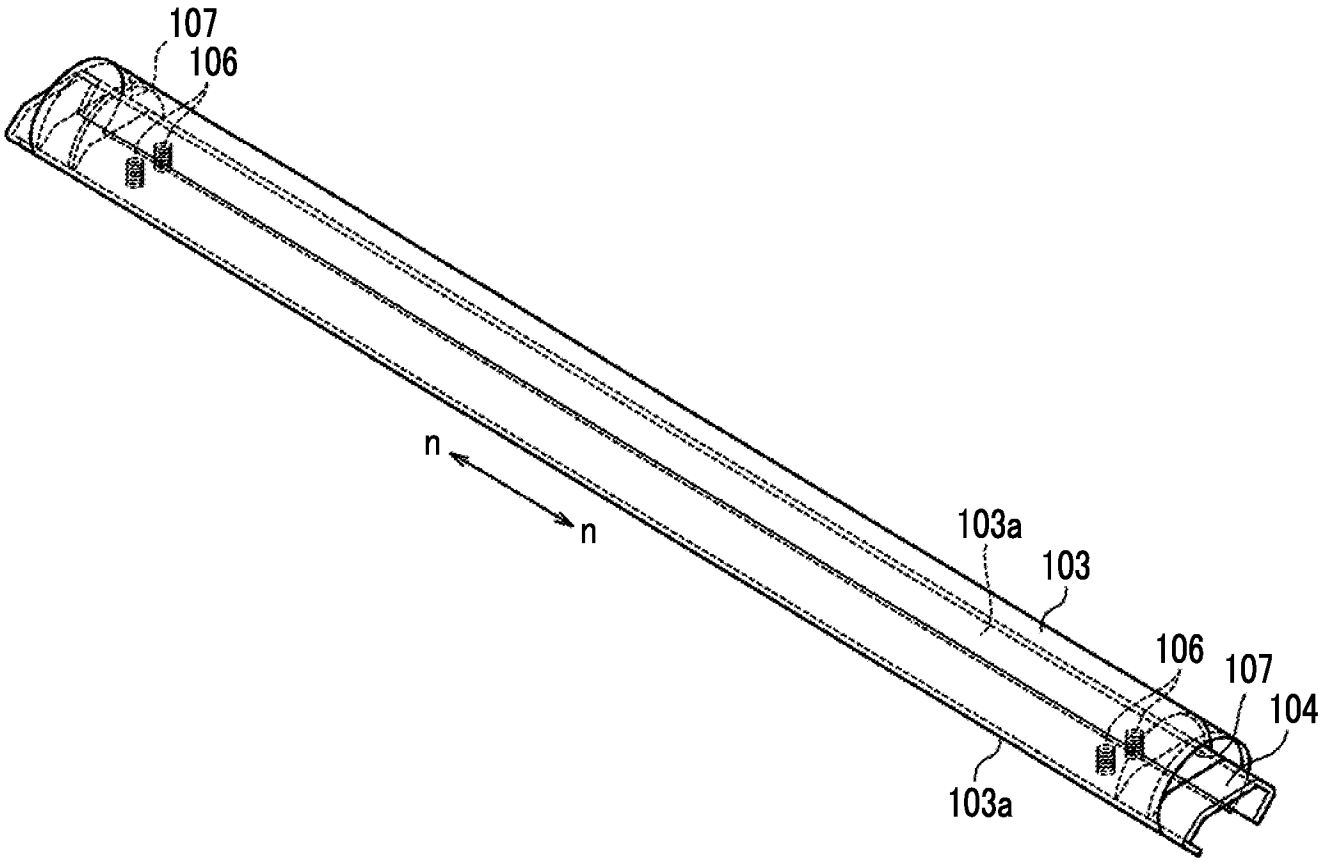
FIG. 4 is a perspective view of an assembly including a heater and a supporting member.

FIG. 4 is a perspective view of an assembly including the heater and the supporting member.

Both the heater 103 and the supporting member 104 are shaped to extend in the arrow n-n direction (width direction of the heating belt 101). In the heater 103, the fixed portions 103*a* at both of the ends of the heating belt 101 in the circular movement direction are fixed to the supporting member 104 and both end portions in the arrow n-n direction are supported by a resin member 107 which has an arc-shaped outer surface. A cavity is formed inside the heater 103, in an area of the heater 103 having the inner surface of the heating belt 101.

Figure 5:
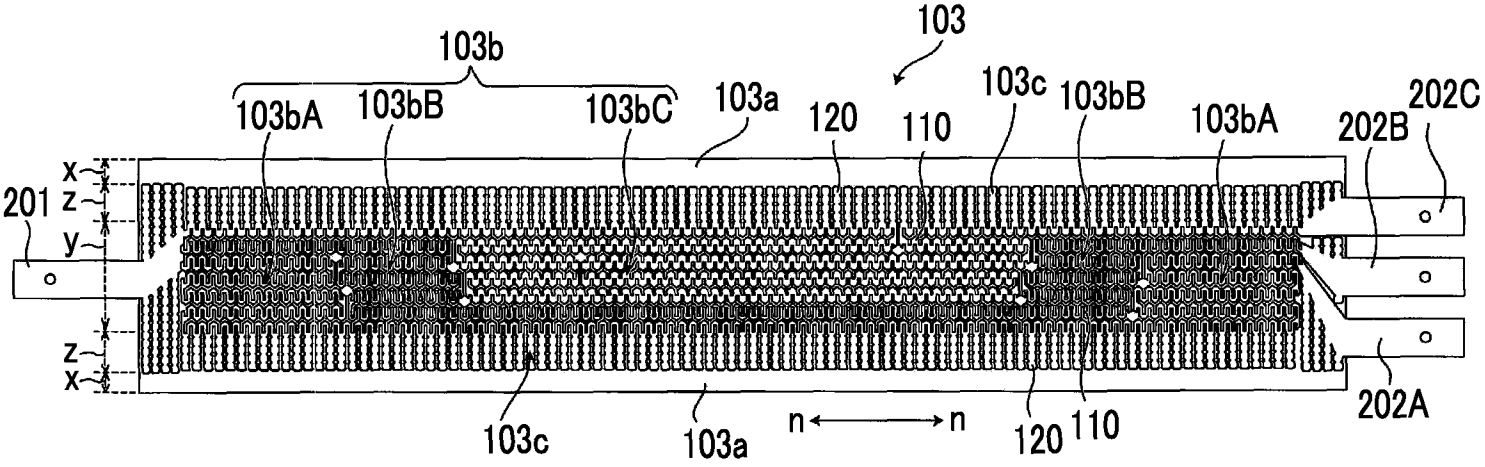
FIG. 5 is a view illustrating a structure of the heater.

FIG. 5 is a view illustrating a structure of the heater.

The heater 103 includes one electrode 201 in an end portion in the arrow n-n direction, and three electrodes, that is, a first electrode 202A, a second electrode 202B, and a third electrode 202C, in the other end portion.

As described above, the heater 103 includes the fixed portions 103*a* in the areas, illustrated with the arrow x, at both ends in the width direction (corresponding to the circular movement direction of the heating belt 101 assembled into the heating unit 100), the heating portion 103*b* in the area at a center in the width direction, which is illustrated with the arrow y, and the rigidity adjusting units 103*c* in the areas on both of the sides of the heating portion 103*b* that are illustrated with the arrow z. The heating portion 103*b* of the heater 103 further includes first heating portions 103*b*A at both ends in a longitudinal direction (arrow n-n direction; width direction of the heating belt 101 assembled into the heating unit 100), a second heating portion 103*b*B inside the first heating portions 103*b*A, and a third heating portion 103*b*C at a center. In the heating portion 103*b*, each of the first heating portions 103*b*A, the second heating portion 103*b*B, and the third heating portion 103*b*C includes the resistance heating element that extends with repeated wave-form swells. The first heating portion 103*b*A connects the electrode 201 and the first electrode 202A with each other. In addition, the second heating portion 103*b*B connects the electrode 201 and the second electrode 202B with each other, and the third heating portion 103*b*C connects the electrode 201 and the third electrode 202C with each other. Accordingly, the first heating portion 103*b*A generates heat when energized between the electrode 201 and the first electrode 202A. Likewise, the second heating portion 103*b*B generates heat when energized between the electrode 201 and the second electrode 202B, and the third heating portion 103*b*C generates heat when energized between the electrode 201 and the third electrode 202C. In this exemplary embodiment, the sheets that may be used in the printer 1 illustrated in FIGS. 1 and 2 have plural sizes, and the area where the heat is generated is switched according to the width of the sheet that is used.

The resistance heating elements that are provided in the heating portion 103*b* have different line widths in the first heating portions 103*b*A, the second heating portion 103*b*B, and the third heating portion 103*b*C. This is to equalize the amounts of heat generation per unit area during the energization in a relationship between the lengths of the resistance heating elements respectively provided in the first heating portions 103*b*A, the second heating portion 103*b*B, and the third heating portion 103*b*C.

Figure 6:
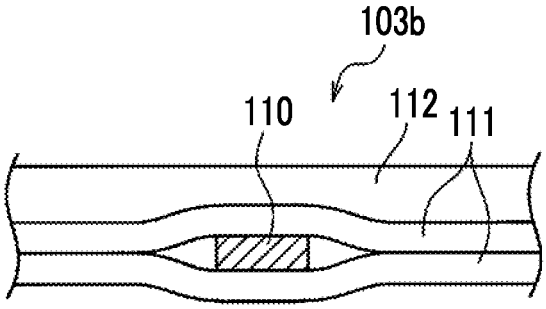
FIG. 6 is a view illustrating a cross-sectional structure of a heating portion of the heater.

FIG. 6 is a view illustrating a cross-sectional structure of the heating portion of the heater.

In the heating portion 103*b* of the heater 103, a resistance heating element 110 that has a thickness of, for example, approximately 30 μm is nipped by polyamide membranes 111 of approximately 25 to 50 μm. Furthermore, a stainless steel membrane 112 that has a thickness of approximately 50 to 70 μm is attached to a side which comes into contact with the inner surface of the heating belt 101. The rigidity adjusting unit 103*c*, which will be described later, has the same structure as the heating portion 103*b*, except that a rigidity adjusting body 120 (refer to FIG. 5) is arranged instead of the resistance heating element 110. In this exemplary embodiment, the rigidity adjusting body 120 that is provided in the rigidity adjusting unit 103*c* uses the same material and has the same thickness as the resistance heating element 110 that is provided in the heating portion 103*b*, is connected to the resistance heating element 110, and is shaped to extend from the resistance heating element 110 toward the fixed portion 103*a*.

The fixed portion 103*a* of the heater 103 has the same structure as in FIG. 6, except that the resistance heating element 110 and the rigidity adjusting body 120 are absent.

Description will be continued, returning to FIG. 5.

The rigidity adjusting bodies 120 are provided in the rigidity adjusting units 103*c* that are disposed at both of the sides of the heating portion 103*b* in the width direction. The rigidity adjusting body 120 is connected to the resistance heating element 110 of the heating portion 103*b*, and is shaped to extend toward the fixed portion 103*a* in the width direction of the heater 103 (circular movement direction of the heating belt 101 assembled into the heating unit 100). During the extension toward the fixed portion 103*a*, the rigidity adjusting body 120 extends while increasing or decreasing the width of the rigidity adjusting body 120. As described above, the rigidity adjusting body 120 is formed of the same material as the resistance heating element 110 and is formed to have the same thickness as the resistance heating element 110. In other words, the rigidity adjusting body 120 is manufactured integrally and simultaneously with the resistance heating element 110. However, each of the rigidity adjusting bodies 120 is connected to the resistance heating element 110 at only one point. As such, no current path is formed in the rigidity adjusting body 120 even when the resistance heating element 110 is energized, and no energization-based heat generation occurs in the rigidity adjusting body 120.

The rigidity adjusting body 120 adjusts the rigidity of the rigidity adjusting unit 103*c*, which is an area adjacent to the heating portion 103*b*, to be almost equal to the rigidity of the heating portion 103*b*. In other words, the rigidity adjusting unit 103*c* includes the rigidity adjusting body 120, and the rigidity of the rigidity adjusting unit 103*c* is closer to the rigidity of the heating portion 103*b* (that is, a site where the resistance heating element 110 is nipped between the polyamide membranes 111) than to the rigidity of the fixed portion 103*a* (that is, a site where nothing is present between the polyamide membranes 111 (refer to FIG. 6)). Specifically, the rigidity of each of the units of the heater 103 has a relationship of heating portion 103*b*≅rigidity adjusting unit 103*c*>fixed portion 103*a*>electrode portion (electrode 201, first electrode 202A, second electrode 202B, third electrode 202C).

Accordingly, bending is prevented on both of the sides of the heating portion 103*b* when the heater 103 is assembled into the heating unit 100, and a smooth curve is made from the heating portion 103*b* to the rigidity adjusting unit 103*c*.

The rigidity adjusting body 120 of the rigidity adjusting unit 103*c* is shaped to extend, while the width is increased and decreased, for a pattern similar to a wave-form swelling pattern of the resistance heating element 110 of the heating portion 103*b* under a condition in which no current path is made in the rigidity adjusting body 120. In this manner, continuous rigidity with respect to the rigidity of the heating portion 103*b* is ensured in the rigidity adjusting unit 103*c* in both the width direction and the longitudinal direction.

The heater 103 is assembled into the heating unit 100 in a state where the heater 103 is curved in the width direction (circular movement direction of the heating belt 101) as described above. The heater 103 has flexibility in this manner and is greatly deformed when generating heat due to the energization. Accordingly, the size of the heat generation area that is in contact with the heating belt 101 changes, by conditions from time to time, when the heating portion 103*b* is widened to the rigidity adjusting unit 103*c* illustrated in FIG. 5 and the heat is generated to the area of the rigidity adjusting unit 103*c*. Then, the amount of heat per unit time that is transmitted to the heating belt 101 changes and it becomes difficult to control the temperature of the heating belt 101. Accordingly, if possible, it is preferable that the heating portion 103*b* be limited to a narrow area in the width direction (circular movement direction of the heating belt 101). In this exemplary embodiment, the heating portion 103*b* is in a central area in the width direction, and the rigidity adjusting unit 103*c* is disposed between the heating portion 103*b* and the fixed portion 103*a*.

Figure 7:
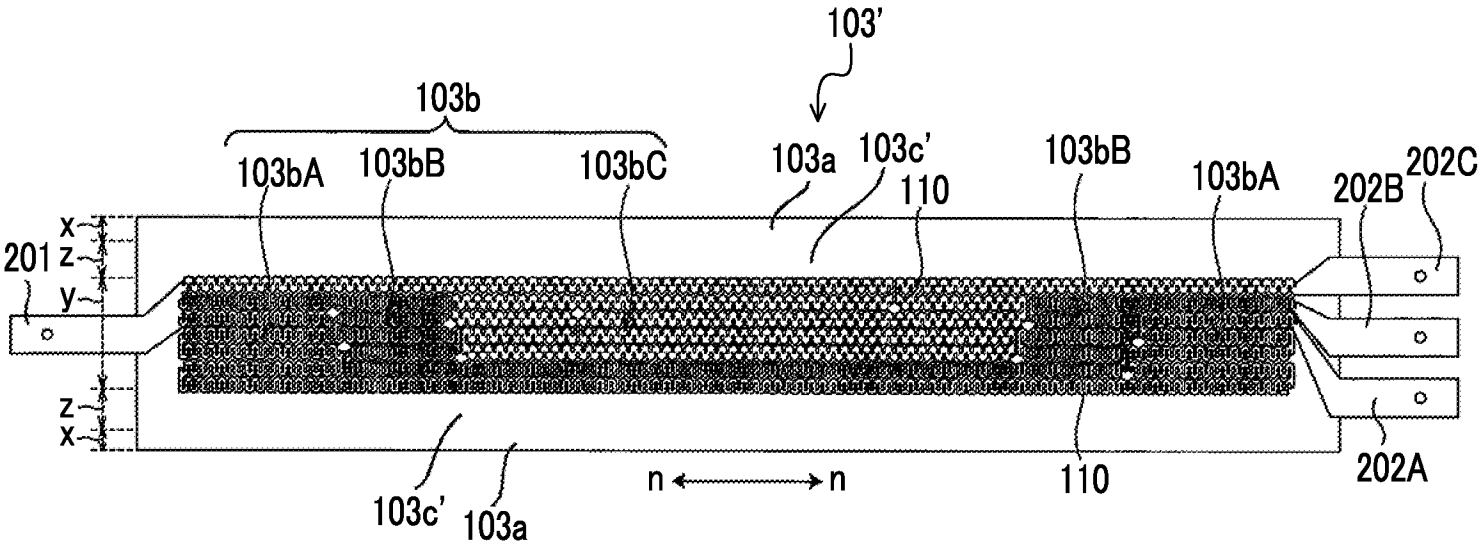
FIG. 7 is a view illustrating a structure of a heater as a comparative example.

FIG. 7 is a view illustrating a structure of a heater as a comparative example. The same reference numerals as in FIG. 5 are given to the same elements in the heater of this exemplary embodiment for ease of understanding, and only differences therebetween will be described.

As compared to the heater 103 illustrated in FIG. 5, the rigidity adjusting body is not provided in an area 103*c*' that corresponds to the rigidity adjusting unit 103*c* of the heater 103 illustrated in FIG. 5 according to a heater 103' as the comparative example illustrated in FIG. 7. The heater 103' illustrated in FIG. 7 is the same as the heater 103 illustrated in FIG. 5 except for this.

Figure 8:
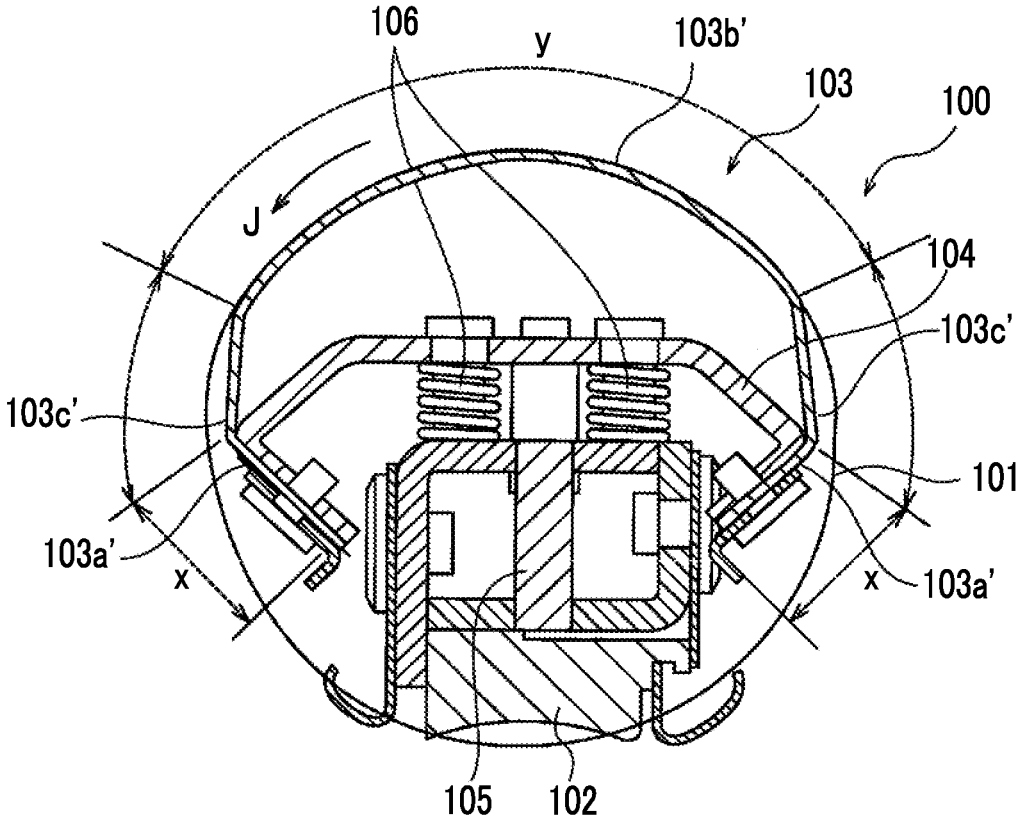
FIG. 8 is a view illustrating a part of a cross section of a heating unit into which the heater according to the comparative example illustrated in FIG. 7 is assembled.

FIG. 8 is a view illustrating a part of a cross section of a heating unit into which the heater according to the comparative example illustrated in FIG. 7 is assembled.

When the heater 103' illustrated in FIG. 7 is assembled into the heating unit, the rigidity varies greatly between the heating portions 103*b* and the area 103*c*' that corresponds to the rigidity adjusting unit 103*c* illustrated in FIG. 5. The heater 103' is bent at a boundary part therebetween, and the curve is not smooth.

The heater 103' expands and contracts due to the energization-based heat generation, and thus the amount of heat transfer per unit time from the heater 103' toward the heating belt 101 changes by the conditions from time to time, and it may become difficult to control the temperature of the heating belt 101 as is when the heating portion 103*b* is widened to the area 103*c*' that corresponds to the rigidity adjusting unit 103*c*.

In this exemplary embodiment, the heating portion 103*b* is in only the central area that is separated from the fixed portion 103*a* as illustrated in FIG. 5, and the rigidity of the rigidity adjusting unit 103*c* directed from the heating portion 103*b* toward the fixed portion 103*a* is adjusted to be almost equal to the rigidity of the heating portion 103*b*. Accordingly, the heat may be stably transferred from the heater 103 toward the heating belt 101, and the temperature of the heating belt 101 may be precisely controlled.

In the exemplary embodiment described above, the rigidity adjusting body 120 that is provided in the rigidity adjusting unit 103*c* uses the same material and has the same thickness as the resistance heating element 110 that is provided in the heating portion 103*b*. However, the rigidity adjusting body 120 may not use the same material as the resistance heating element 110. For example, an electrical insulator, whose degree of rigidity is almost equal to that of the resistance heating element 110 may be used as the material.

In the exemplary embodiment described above, the rigidity adjusting body 120 that is provided in the rigidity adjusting unit 103*c* is connected to the resistance heating element 110 that is provided in the heating portion 103*b*. However, the rigidity adjusting body 120 may be independent from the resistance heating element 110 without being connected to the resistance heating element 110. The resistance heating element 110 that is provided in the heating portion 103*b* extends in the longitudinal direction with the wave-form swells, but some gaps are present between the two adjacent wave forms. Such gap may also be present between the rigidity adjusting body 120 and the resistance heating element 110 such that the same wave form as the resistance heating element 110 is formed.

The rigidity adjusting unit 103*c* is an area for extending the rigidity of the heating portion 103*b* as it is toward the fixed portion 103*a*. However, the material and the shape of the rigidity adjusting body 120 are not particularly limited thereto insofar as the purpose of the structure is met.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heating unit that includes a circularly moving heating belt; and a pressurizing roller that presses an external face of the heating belt, the fixing device fixing a toner image on a sheet onto the sheet by nipping the sheet between the heating belt and the pressurizing roller and by heating and pressurizing the sheet transported with the toner image being held, wherein the heating unit, further includes:

a backing member that is arranged on an inner surface side of an area of the heating belt which is pressed by the pressurizing roller, and receives pressurization from the pressurizing roller;

a heater that has a plate shape, is arranged on an inner side of the heating belt in a state of being curved in a circular movement direction of the heating belt, and comes into contact with an inner surface of the heating belt to heat the heating belt from the inner side; and a supporting member that is arranged on the inner side of the heating belt, and fixes a fixed portion of the heater in the circular movement direction, and wherein the heater, further includes:

a heating portion that includes a resistance heating element which is energized to generate heat; and a rigidity adjusting unit that is formed between the heating portion and the fixed portion in the circular movement direction, and includes a rigidity adjusting body which has a rigidity that is substantially the same as a rigidity of the heating portion without generating heat by energization.

2. The fixing device according to claim 1, wherein the rigidity adjusting body is formed of a same material as the resistance heating element that is provided in the heating portion.

3. The fixing device according to claim 1, wherein the rigidity adjusting body is connected to the resistance heating element that is provided in the heating portion.

4. The fixing device according to claim 2, wherein the rigidity adjusting body is connected to the resistance heating element that is provided in the heating portion.

5. The fixing device according to claim 1, wherein the rigidity adjusting body is shaped to extend in the circular movement direction from the heating portion toward the fixed portion.

6. The fixing device according to claim 2, wherein the rigidity adjusting body is shaped to extend in the circular movement direction from the heating portion toward the fixed portion.

7. The fixing device according to claim 3, wherein the rigidity adjusting body is shaped to extend in the circular movement direction from the heating portion toward the fixed portion.

8. The fixing device according to claim 4, wherein the rigidity adjusting body is shaped to extend in the circular movement direction from the heating portion toward the fixed portion.

9. The fixing device according to claim 5, wherein the rigidity adjusting body is shaped to extend in the circular movement direction from the heating portion toward the fixed portion with a varying width that repeatedly increases and decreases in a direction perpendicular to the circular movement direction.

10. The fixing device according to claim 6, wherein the rigidity adjusting body is shaped to extend in the circular movement direction from the heating portion toward the fixed portion with a varying width that repeatedly increases and decreases in a direction perpendicular to the circular movement direction.

11. The fixing device according to claim 7, wherein the rigidity adjusting body is shaped to extend in the circular movement direction from the heating portion toward the fixed portion with a varying width that repeatedly increases and decreases in a direction perpendicular to the circular movement direction.

12. The fixing device according to claim 8, wherein the rigidity adjusting body is shaped to extend in the circular movement direction from the heating portion toward the fixed portion with a varying width that repeatedly increases and decreases in a direction perpendicular to the circular movement direction.

13. An image forming apparatus comprising:

a toner image forming unit that forms an unfixed toner image on a sheet by using toner while transporting the sheet; and a fixing unit that includes a heating unit which includes a circularly moving heating belt, and a pressurizing roller which presses an external face of the heating belt, the fixing unit fixing the toner image on the sheet onto the sheet by nipping the sheet between the heating belt and the pressurizing roller and by heating and pressurizing the sheet transported with the toner image formed by the toner image forming unit being held, wherein the heating unit, further includes:

a backing member that is arranged on an inner surface side of an area of the heating belt which is pressed by the pressurizing roller, and receives pressurization from the pressurizing roller;

a heater that has a plate shape, is arranged on an inner side of the heating belt in a state of being curved in a circular movement direction of the heating belt, and comes into contact with an inner surface of the heating belt to heat the heating belt from the inner side; and a supporting member that is arranged on the inner side of the heating belt, supports the backing member, and fixes a fixed portion of the heater in the circular movement direction, and wherein the heater, further includes:

a heating portion that includes a resistance heating element which is energized to generate heat; and a rigidity adjusting unit that is formed between the heating portion and the fixed portion in the circular movement direction, and includes a rigidity adjusting body which has a rigidity that is substantially the same as a rigidity of the heating portion without generating heat by energization.

14. The fixing device according to claim 1, wherein the resistance heating element extends in a repeated wave shape.

15. The image forming apparatus according to claim 13, wherein the resistance heating element extends in a repeated wave shape.

* * * * *